US010928066B2

(12) United States Patent
Lucas et al.

(10) Patent No.: US 10,928,066 B2
(45) Date of Patent: Feb. 23, 2021

(54) SYSTEM AND METHOD FOR THE ADVANCED CONTROL OF NITROGEN OXIDES IN WASTE TO ENERGY SYSTEMS

(71) Applicant: ECO Burn Inc., Burlington (CA)

(72) Inventors: Jean Lucas, Burlington (CA); Jun Xiao, Burlington (CA); Kim Docksteader, Burlington (CA)

(73) Assignee: ECO BURN INC., Burlington (CA)

( * ) Notice: Subject to any disclaimer, the term of this patent is extended or adjusted under 35 U.S.C. 154(b) by 77 days.

(21) Appl. No.: 16/274,946

(22) Filed: Feb. 13, 2019

(65) Prior Publication Data

US 2020/0256559 A1 Aug. 13, 2020

(51) Int. Cl.

*F23G 5/50* (2006.01)
*F23M 5/00* (2006.01)
*F23N 5/00* (2006.01)

(52) U.S. Cl.

CPC ..... *F23G 5/50* (2013.01); *F23N 5/003* (2013.01); *F23G 2201/101* (2013.01); *F23G 2207/104* (2013.01); *F23G 2207/105* (2013.01); *F23G 2207/30* (2013.01); *F23G 2900/00001* (2013.01); *F23G 2900/50001* (2013.01); *F23G 2900/55003* (2013.01)

(58) Field of Classification Search

CPC ..... F23G 5/50; F23G 2201/101; F23G 2207/104; F23G 2207/105; F23G 2900/55003; F23G 2900/50001; F23G 2900/00001; F23G 2207/30; F23N 5/003

See application file for complete search history.

(56) References Cited

U.S. PATENT DOCUMENTS 3,995,568 A * 12/1976 Dvirka ..... F23G 5/002 110/190
4,495,872 A * 1/1985 Shigaki ..... F23G 5/002 110/188
4,838,183 A * 6/1989 Tsaveras ..... F23G 5/002 110/101 C
4,953,477 A * 9/1990 Martin ..... F23N 5/082 110/190
5,261,337 A * 11/1993 Orita ..... F23N 5/006 110/346
5,634,412 A * 6/1997 Martin ..... F23N 5/082 110/101 CA
5,762,008 A * 6/1998 Martin ..... F23G 5/50 110/345

(Continued)

*Primary Examiner* — David J Laux

(74) *Attorney, Agent, or Firm* — Slayden Grubert Beard PLLC

(57) ABSTRACT

The present embodiments provide an incinerator which includes a system for reducing NOx and CO emissions. A computational fluid dynamics module is configured to generate a plurality of models related to a plurality of incinerator parameters. A programmable logic controller dynamically maintains a plurality of set points. Further, the programmable logic controller receives a plurality of output signals from a plurality of sensors and compares the plurality of output signals with the plurality of set points. The programmable logic controller is further to affect an amount of above-fire combustion air, an amount of under-fire combustion air, and an amount of above-fire and under-fire flue gas recirculation to reduce NOx emissions produced by the incinerator.

19 Claims, 3 Drawing Sheets

(56) References Cited

U.S. PATENT DOCUMENTS

| | | | | |
|---|---|---|---|---|
| 7,832,342 | B2 * | 11/2010 | Martin | F23G 5/50 110/204 |
| 7,975,628 | B2 * | 7/2011 | Martin | F23J 7/00 110/346 |
| 8,443,739 | B2 * | 5/2013 | Goff | F23L 9/04 110/191 |
| 9,134,022 | B2 * | 9/2015 | Hunsinger | F23B 80/02 |
| 10,180,254 | B2 * | 1/2019 | Brennwald | F23J 1/00 |
| 2008/0163803 | A1 * | 7/2008 | Barker | F23G 5/008 110/185 |
| 2020/0182462 | A1 * | 6/2020 | Lucas | F23G 5/38 |

* cited by examiner

SYSTEM AND METHOD FOR THE ADVANCED CONTROL OF NITROGEN OXIDES IN WASTE TO ENERGY SYSTEMS

TECHNICAL FIELD

The embodiments relate to the reduction of chemical waste in combustion chambers, and in particular, to a system and method for reducing nitrogen oxides during the combustion of waste in a waste-to-energy system.

BACKGROUND

Traditional incinerators have been used in the United States since the early 19$^{th}$ century and were initially constructed to convert waste materials into ash, flue gas, and waste heat by combusting organic substances within a loaded waste material. These initial forms of incineration released harmful gaseous compounds and particulates directly into the environment without prior "scrubbing." When emitted into the air, fine particulates, heavy metals, trace dioxin, and acid gas were later inhaled by third-parties.

Today waste incineration and the inability to properly handle ash and heavy metals remain dangerous to the environment and toxic to humans. In response to this hazard, lobbying has led to a new generation of cleaner waste-to-energy innovation. Included within these innovations are systems which incorporate thermal and non-thermal applications including advanced incinerator, gasification, and pyrolysis which can convert gaseous effluents into electrical energy.

Combustion at high temperatures can generate nitrogen oxides (often referred to as NOx). NOx may be formed by the reaction of free radicals of nitrogen and oxygen in the air, as well as by the oxidation of nitrogen-containing species in the fuel such as those that may be found in heavy fuel oil, municipal waste solids, and coal.

Previous treatments for NOx have included various chemical or catalytic methods. Such methods include, for example, nonselective catalytic reduction (NSCR), selective catalytic reduction (SCR), and selective noncatalytic reduction (SNCR). Such methods typically require some type of reactant for removal of NOx emissions. The NSCR method can involve using unburned hydrocarbons and CO to reduce NOx emissions in the absence of O2.

SUMMARY OF THE INVENTION

This summary is provided to introduce a variety of concepts in a simplified form that is further disclosed in the detailed description. This summary is not intended to identify key or essential inventive concepts of the claimed subject matter, nor is it intended for determining the scope of the claimed subject matter.

The present embodiments disclose an incinerator which includes a system for reducing NOx and CO emissions. A computational fluid dynamics (CFD) system is designed and used to simulate fluid flow in the primary and secondary chambers to optimize and determine the chamber dimensions and shapes. The CFD system also determines the nozzle injection rate and angle of injection into the primary and secondary chambers while analyzing the rate of combustion and rate of flue gas recirculation. A programmable logic controller dynamically maintains a plurality of set points. The programmable logic controller receives a plurality of output signals from a plurality of sensors, and compares the plurality of output signals with the plurality of pre-programmed set points. The programmable logic controller is further configured to regulate the amount of above-fire and under-fire combustion air, and the amount of above-fire and under-fire flue gas recirculation to reduce NOx emissions produced by the incinerator.

In one aspect, the incinerator comprises a primary combustion chamber configured to receive waste materials from a loader to produce an amount of partially combusted waste materials.

In one aspect, a secondary combustion chamber is in communication with the primary combustion chamber. The secondary combustion chamber is configured to receive the amount of partially combusted waste materials and to produce substantially combusted waste materials and an amount of oxidized flue gas.

In one aspect, a heat recovery system is in communication with the secondary combustion chamber. The heat recovery system is configured to receive the substantially combusted waste materials for transfer to a cyclone.

In one aspect, the cyclone filters precipitate from the oxidized flue gas, and the oxidized flue gas is recirculated to the secondary combustion chamber.

In another aspect, the plurality of sensors includes at least one of the following: at least one oxygen sensor, at least one temperature sensor, at least one NOx sensor, and at least one CO sensor.

In one aspect, the amount of above-fire combustion air and the amount of under-fire combustion air are controlled by one or more combustion air dampers while the amount of above-fire and under-fire flue gas is controlled by one or more flue gas dampers. The amount of above-fire combustion air and the amount of under-fire combustion air each have an oxygen content of about 21%.

In one aspect, a plurality of injection nozzles is positioned in the primary combustion chamber and the secondary combustion chamber.

In one aspect, a method for controlling NOx and CO emissions of an incinerator is provided. A plurality of emissions outputs is transmitted to the programmable logic controller. To reduce NOx and CO emissions, incinerator parameters are measured via a plurality of sensors and compared with the efficient model defined by a plurality of set points. The programmable logic controller then controls an amount of above-fire combustion air, an amount of under-fire combustion air, and an amount of above-fire flue gas, and an amount of under-fire flue gas recirculation to reduce emissions of NOx and CO from the incinerator. The combined combustion air with flue gas recirculation will help to reduce flame temperature and actual gas oxygen and nitrogen content in the primary chamber and secondary chamber, resulting in lower formation of thermal NOx.

BRIEF DESCRIPTION OF THE DRAWINGS

A more complete understanding of the embodiments and the advantages and features thereof will be more readily understood by reference to the following detailed description when considered in conjunction with the accompanying drawings wherein.

DETAILED DESCRIPTION

Figure 1:
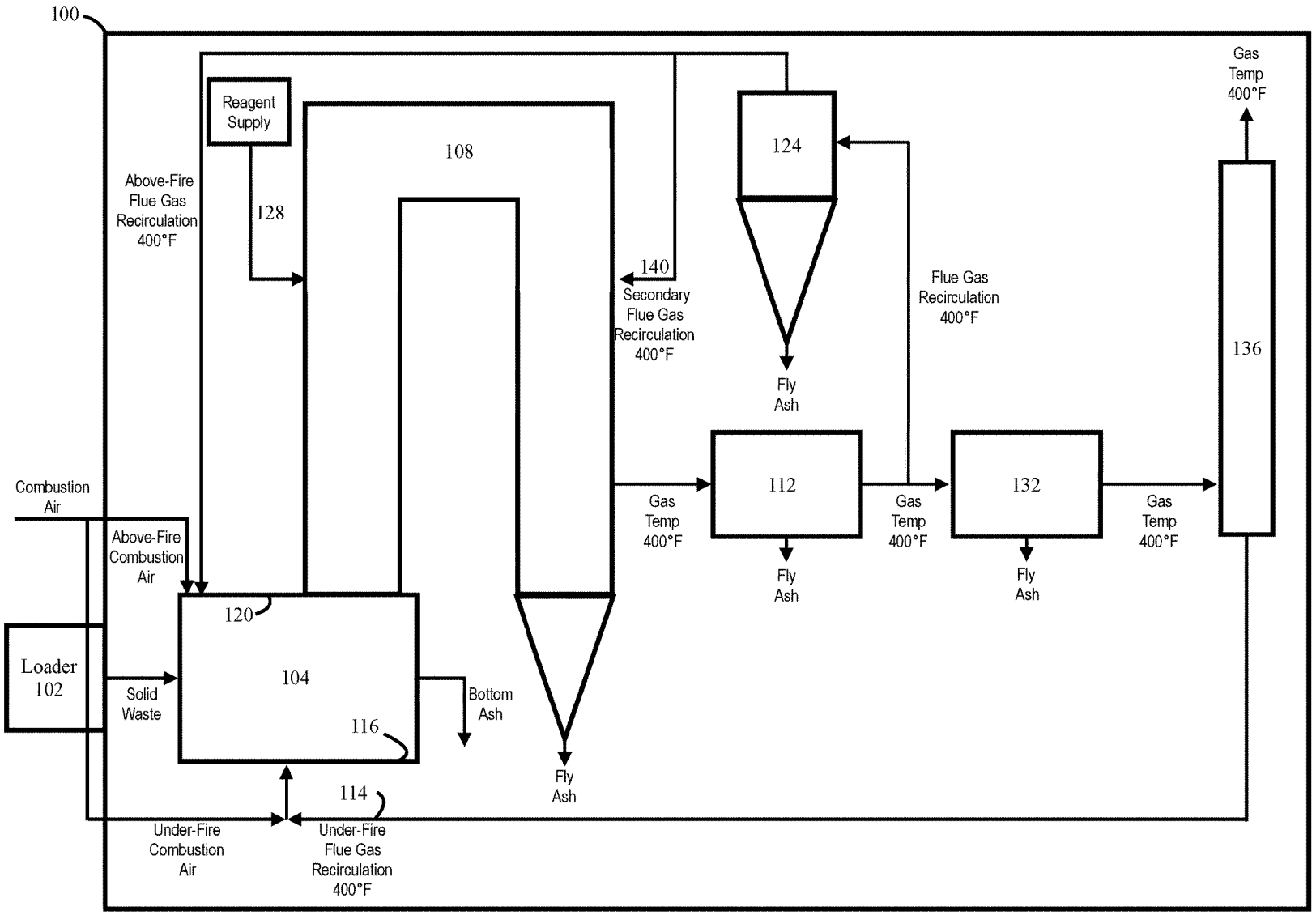
FIG. 1 illustrates a schematic of the incinerator having a NOx reduction system, according to some embodiments.

The specific details of the single embodiment or variety of embodiments described herein are to the described system and methods of use. Any specific details of the embodiments are used for demonstration purposes only and not unnecessary limitations or inferences are to be understood therefrom.

Before describing in detail exemplary embodiments, it is noted that the embodiments reside primarily in combinations of components related to the system and method. Accordingly, the system components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

As used herein, relational terms, such as "first" and "second" and the like, may be used solely to distinguish one entity or element from another entity or element without necessarily requiring or implying any physical or logical relationship or order between such entities or elements.

In general, the embodiments provided herein relate to a waste-to-energy conversion system which burns waste materials and recovers thermal energy. The system utilizes an incinerator which dynamically recirculates gasses by monitoring various temperatures and oxygen levels throughout the system.

FIG. 1 illustrates an incinerator 100 having a primary combustion chamber 104 wherein waste materials are disposed and combusted to produce a flue gas. A loader 102 loads waste materials into the primary combustion chamber 104. The flue gas is oxidized in the primary combustion chamber 104 before being transferred to the secondary combustion chamber 108 along with the combusted waste materials. Each combustion chamber 104, 108 can be constructed as any one of several types of chambers, such as rotary kiln and moving or fixed hearth. The oxidized flue gas and combusted waste materials are transferred to a heat recovery system 112. Following the heat recovery system 112, a portion of the flue gas is recirculated to the primary combustion chamber 104 and secondary combustion chamber 108. Flue gas transferred to the primary combustion chamber 104 can be recirculated in two ways. The first includes a first portion 114 of the clean flue gas after scrubbing system 132 mixing with fresh under-fire air. The mixture of flue gas and the under-fire air is then injected into the hearth portion 116 primary combustion chamber 104 via apertures. The second includes a second portion of the flue gas mixing with above-fire air and injected into apertures positioned on the top portion 120 of the primary combustion chamber 104. The amount of flue gas partitioned into each of the first and second portions recirculated to the primary combustion chamber 104 is controlled depending on various temperatures and oxygen levels within the incinerator 100.

Gases and fly ash emitted from the partially combusted waste material as well as residual oxygen from the primary combustion chamber 104 enter into a secondary combustion chamber 108 where additional combustion occurs until the waste material is substantially combusted. Oxygen content is often controlled at less than 6%. An array of nozzles in the wall of the primary combustion chamber 104 injects cooled, recycled flue gases into the primary combustion chamber 104. These recycled gases enter the primary combustion chamber 104 immediately above the flames. The cooled, recycled flue gases maintain the temperature in the primary combustion chamber 104 at a predetermined temperature, generally about 1500 to 1832° F. Similarly, the gases rising from the primary combustion chamber 104 into the second combustion chamber 108 are at temperatures between about 1500 to 1832° F.

In some embodiments, the gas temperatures in the primary combustion chamber 104 ranges from 1500-1832° F. A set temperature within the primary combustion chamber 104, such as, for example, 1812° F. is controlled by gas dampers via a PLC 270 (shown in FIG. 2). Flue gas can be provided from the combustion air mixed with recirculated flue gas injected from the top portion 120 and hearth portion 116 of the primary combustion chamber 104. PLC 270 provides a dynamic means of controlling the combustion air fan along with a plurality of oxygen content sensors in communication with the gas dampers. Under-fire air is mixed with the first portion of recirculated flue gas and injected into the hearth portion 116 of the primary chamber 104. In some embodiments, the mix is injected underneath a waste pile within the primary combustion chamber 104. The under-fire and above-fire air maintain continuous combustion of waste materials within the primary combustion chamber 104 while keeping the waste material chamber at a near-constant temperature. Waste material may be maintained at a temperature of 1400° F. to prevent metal or glass waste materials from melting which can result in blocked nozzles, and damage to the refractory layer of the primary combustion chamber 104.

Transfer of gasses is facilitated by conduit connecting the primary combustion chamber 104, secondary combustion chamber 108, heat recovery system 112, cyclone 124, air pollution control system 132, and stack 136.

Injection nozzles 120 are provided on various surfaces of the primary combustion chamber 104. Each injection nozzle 120 can be configured to pivot, rotate, or otherwise articulate to change the angle of injection of fresh, above-fire, and air.

In some embodiments, combustion air may be preheated by an air plenum of the primary combustion chamber 104. The second portion of flue gas recirculated via a recirculation blower downstream of the heat recovery system 112 which has a gas temperature of about 400° F. The under-fire flue gas is recirculated via a second recirculation blower downstream of the air pollution control system 132 and has a temperature of about 400° F.

In some embodiments, a cyclone 124 is utilized as a filter to precipitate fly ash from the remaining constituents of the flue gas. One skilled in the arts will understand that any suitable filter or gas-solids separator including, for example, a cyclone or a precipitator. The cyclone 124 may be any cyclone separator commercially available used to separate particulates from gases. A single cyclone 124 or multiple cyclones can be used. The cyclone 124 can be a multiple-tube cyclone which cleans hot gas to rid the gas of particles.

The size, shape, and dimension of the primary combustion chamber 104 and secondary combustion chamber 108 can be optimized by computational fluid dynamics (CFD) to optimize mixing and turbulence. Using CFD allows for the simulation of the gas flow routine to determine an optimal mixing method, injection angles of a plurality of nozzles (not shown), and positions of the inlets of combustion air mixed with recirculated flue gas.

In some embodiments, an SNCR process is utilized in the secondary combustion chamber 108 which is supplied with post-combustion flue gas from the primary combustion chamber 104 and the heat recovery system 112. The SNCR process utilized in the secondary combustion chamber 108 is a post-combustion NOx reduction process which reduces NOx via the controlled injection of a reagent, via a reagent supply line 128 (such as diluted urea) into the post-combustion flue gas path. The amount, distribution, and the injection position, and the injection angle of the reagent for the SNCR process is optimized by CFD simulations to achieve maximum NOx reduction efficiency, minimum ammonia slip, and minimum reagent consumption.

In some embodiments, the reagent can include a urea solution or an ammonia solution. The ammonia solution may be used in the SNCR method in the secondary combustion chamber 108.

Figure 2:
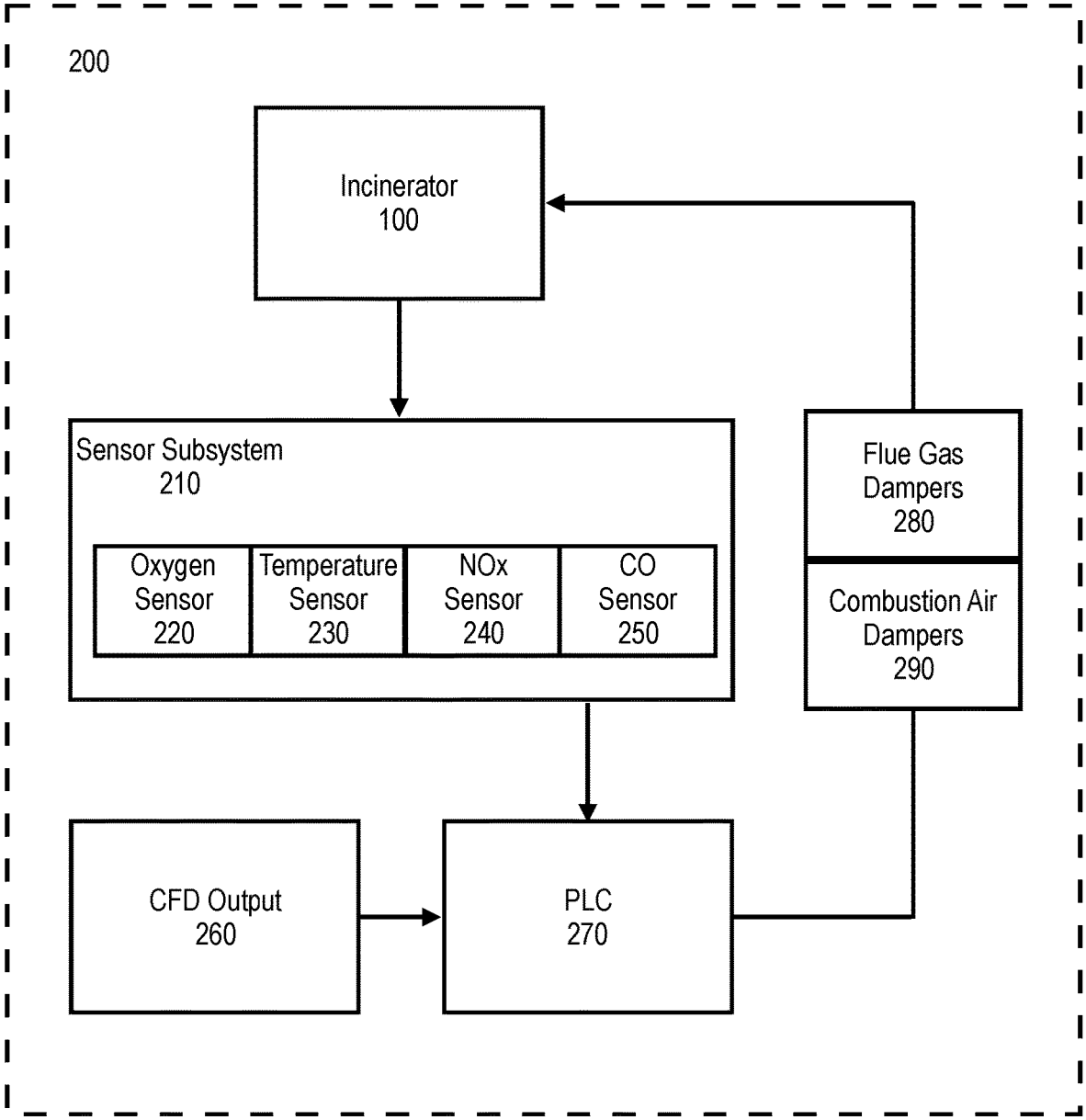
FIG. 2 illustrates a block diagram of the NOx reduction control system, according to some embodiments.

FIG. 2 illustrates a block diagram of the control system 200 in an exemplary embodiment. To improve incinerator efficiency while reducing NOx emissions, various incinerator parameters are measured to alter the components of the incinerator 100 dynamically. As discussed herein, the incinerator 100 includes a sensor subsystem 210 which can include but is not limited to oxygen sensors 220, temperature sensors 230, NOx sensors 240, and carbon monoxide (CO) sensors 250 each positioned throughout various components of the incinerator 100. Each sensor provides an output signal to a programmable logic controller (PLC) 270. The PLC 270 receives input from the sensor 210 to affect various components of the incinerator 100.

In some embodiments, the PLC 270 dynamically controls the amount of flue gas transferred to each of the primary and secondary combustion chambers 104, 108 based on the desired temperature and oxygen levels. The PLC 270 may also control the angle of the injection nozzles 120.

Oxygen sensors 220 measure oxygen levels and transmits output signals thereof to the PLC 270. An output signal is sent from the PLC 270 to control the opening and closing of combustion air dampers 290 which supply fresh air at a rate determined by the PLC 270 to maintain a given oxygen level within the incinerator 100. The PLC 270 affects the combustion air dampers 290 and flue gas dampers 280 independently to ensure the stability of various temperatures in the incinerator 100. Temperature stability provides complete combustion of the waste materials while minimizing the generation of thermal NOx. The formation of CO is restrained to acceptable levels which are predetermined by laws and regulations.

In some embodiments, ambient air having an oxygen content of about 21% is used as the combustion air for the overall reduction of NOx emissions. The oxygen content (21%) of ambient air is advantageous in providing high gas temperatures which results in complete combustion of waste materials and vitrification of bottom ash.

A temperature sensor 230, for example, a thermocouple, is used to measure the temperature inside the primary combustion chamber 104, the secondary combustion chamber 108, while the PLC 270 compares the measured primary combustion chamber 104 and secondary combustion chamber 108 temperatures, with one or more temperature set points. The PLC 270 then opens or closes flue gas dampers 280 accordingly, returning the required amount of recycled flue gases to the primary combustion chamber 104 and/or secondary combustion chamber 108. The recycling of cooled flue gases ensures better control of temperature in the primary combustion chamber 104 than when recycling is absent. It also increases the degree of combustion of the flue gases.

In some embodiments, NOx sensors 240 and CO sensors 250 are positioned on various components of the incinerator, most notably the stack 136 to measure emissions of NOx out of the incinerator 100 to ensure proper emission levels.

An SNCR method is provided to the secondary combustion chamber 108 to reduce NOx post-combustion in the primary chamber by up to 85%. A reagent (such as a urea solution) is dynamically injected into the secondary combustion chamber 108, via injection nozzles 128. The reagent amount, distribution of injection across the injection nozzles 128, and angle of the injection nozzles is controlled and optimized by the PLC 270. The CFD 260 is used to aid in determining various incinerator parameters which include the maximum NOx destruction efficiency, minimum ammonia slip, and minimum reagent consumption.

In some embodiments, temperature measurements and oxygen content control via flue gas recirculation are provided in the primary combustion chamber 104 wherein flue gas combustion and combustion air injection take place. Flue gas recirculation and combustion air injection may not be present in the secondary combustion chamber 108.

One skilled in the arts will understand that additional sensors including timers, pressure sensors, and infrared sensors can be in operable communication to provide further output signals to the PLC 270.

In some embodiments, the following incinerator parameters may be set points for the PLC 270. The reduction of NOx via SNCR is between 60-85%. Temperatures in the primary combustion chamber 104 may range between 1562-1832° F. The secondary chamber 108 may have temperatures between 1562-1832° F. A CO limit may be set, via the PLC 270, at the secondary combustion chamber inlet at 200 ppm while a CO limit at the secondary combustion chamber 108 may be set at 10 ppm. In one example, oxygen content may be set, via the PLC 270, at the secondary combustion chamber inlet at 6%. Post-Injection residence time may be set to two seconds.

In one aspect, a method for controlling NOx and CO emissions of an incinerator is provided. A plurality of emissions outputs (including NOx emissions and CO emissions) are modeled via a computation fluid dynamics module. An efficient model is determined which reduces NOx and CO emissions. The efficient module is determined by analyzing the emissions outputs for each model generated. The model having the lowest NOx and CO emissions while maintaining incinerator efficiency is selected. A signal output corresponding to the efficient model is transmitted to the programmable logic controller. Incinerator parameters are measured via a plurality of sensors and compared with the efficient model defined by a plurality of set points. The programmable logic controller then controls an amount of above-fire and under-fire combustion air, and an amount of above-fire and under-fire flue gas recirculation to reduce emissions of NOx and CO from the incinerator.

Figure 3:
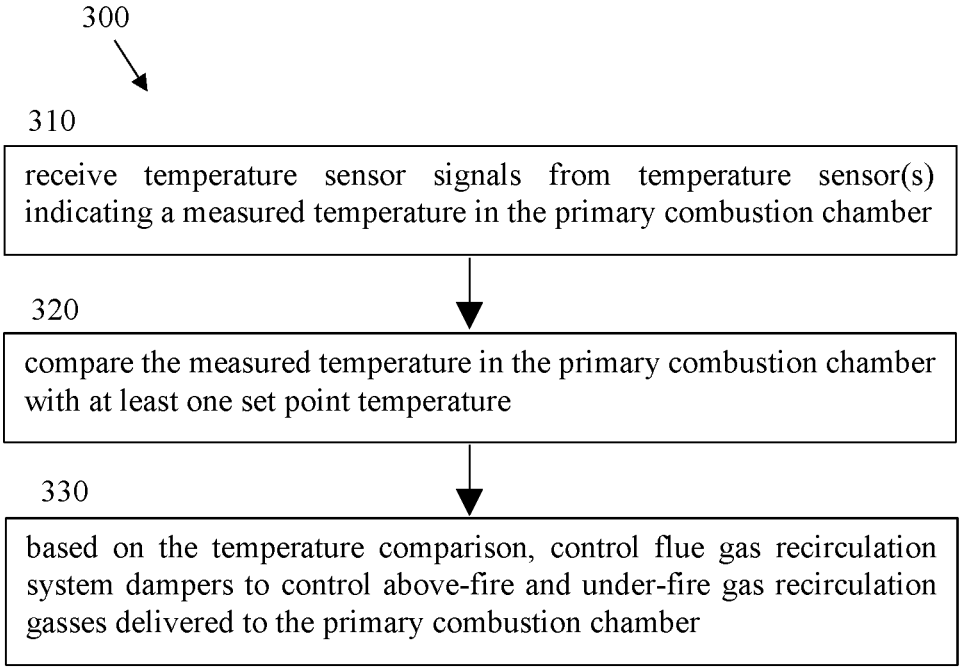
FIG. 3 illustrates a flow chart of an example method for temperature-based control of a flue gas recirculation system.

FIG. 3 shows a flow chart of an example method 300 for temperature-based control of the example flue gas recirculation system shown in FIGS. 1 and 2, according to one embodiment. At 310, the PLC 270 receives sensors signals including temperature sensor signals from a temperature sensor 230 used to measure the temperature in the primary combustion chamber 104. At 320, the PLC 270 may compare the measured temperature in the primary combustion chamber 104 with one or more temperature set points. At 330, based on the temperature comparison, the PLC 270 may open or close glue gas dampers 280 to control the above-fire and under-fire gas recirculation gasses delivered to the primary combustion chamber 104, to thereby control the temperature in the primary combustion chamber 104. For example, the flue gas dampers 280 may be opened, which increases flue gas recirculation to the primary combustion chamber 104, to lower the temperature in the primary combustion chamber 104.

Many different embodiments have been disclosed herein, in connection with the above description and the drawings. It will be understood that it would be unduly repetitious and obfuscating to literally describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

An equivalent substitution of two or more elements can be made for any one of the elements in the claims below or that a single element can be substituted for two or more elements in a claim. Although elements can be described above as acting in certain combinations and even initially claimed as such, it is to be expressly understood that one or more elements from a claimed combination can in some cases be excised from the combination and that the claimed combination can be directed to a subcombination or variation of a subcombination.

It will be appreciated by persons skilled in the art that the present embodiment is not limited to what has been particularly shown and described hereinabove. A variety of modifications and variations are possible in light of the above teachings without departing from the following claims.

What is claimed is:

1. An incinerator having a system that provides flue gas recirculation and selective noncatalytic reduction (SNCR) for reducing NOx and CO emissions, the system comprising:

a primary combustion chamber configured to receive waste materials from a loader or other source;

a secondary combustion chamber configured to receive partially combusted waste materials from the primary combustion chamber and produce substantially combusted waste materials and an amount of oxidized flue gas;

a flue gas recirculation system downstream of the secondary combustion chamber, the flue gas recirculation system configured to deliver (a) above-fire flue gas recirculation gas and (b) under-fire gas recirculation gas to the primary combustion chamber to reduce a temperature in the primary combustion chamber to provide a first NOX reduction in the flue gas;

an SNCR system configured to deliver a controlled amount of SNCR reagent to the secondary combustion chamber to provide a second NOX reduction in the flue gas;

a plurality of sensors configured to measure a plurality of incinerator parameters, including at least one temperature sensor associated with the primary combustion chamber;

a programmable logic controller in operable communication with the plurality of sensors to dynamically maintain a plurality of set points, the programmable logic controller configured to:

control the above-fire and under-fire gas recirculation gases delivered to the primary combustion chamber, including:

receiving output signals from the at least one temperature sensor indicating a measured temperature in the primary combustion chamber;

comparing the measured temperature in the primary combustion chamber with at least one set point temperature; and based at least on the comparison of the measured temperature in the primary combustion chamber with the at least one set point temperature, dynamically controlling one or more dampers of the flue gas recirculation system to control the above-fire and under-fire gas recirculation gasses delivered to the primary combustion chamber;

control the amount of above-fire combustion air and the amount of under-fire combustion air delivered to the primary combustion chamber based on sensor signals received from the sensor system; and control at least one injection nozzle to adjust an angle of injection of the SNCR reagent into the secondary combustion chamber.

2. The system of claim 1, wherein the flue gas recirculation system comprises a heat recovery system and a cyclone.

3. The system of claim 2, wherein the cyclone filters precipitates from the oxidized flue gas, wherein the oxidized flue gas is recirculated to the secondary combustion chamber.

4. The system of claim 1, wherein the plurality of sensors further includes at least one of the following: at least one oxygen sensor, at least one NOx sensor, or at least one CO sensor.

5. The system of claim 1, wherein the programmable logic controller is further configured to control one or more combustion air dampers to control an amount of above-fire combustion air and an amount of under-fire combustion air delivered to the primary combustion chamber.

6. The system of claim 5, wherein the amount of above-fire combustion air and the amount of under-fire combustion air delivered to the primary combustion chamber each have an oxygen content of about 21%.

7. The system of claim 1, wherein:

the one or more set points define an oxygen concentration limit at an inlet of the primary combustion chamber; and the programmable logic controller is configured to control flue gas recirculation system based on a comparison of the sensor output signals and the oxygen concentration limit.

8. The system of claim 1, wherein:

the flue gas recirculation system is further configured to deliver secondary recirculation gas to the secondary combustion chamber; and the programmable logic controller is configured to dynamically control the secondary recirculation gas delivered to the secondary combustion chamber.

9. The system of claim 1, wherein the programmable logic controller is configured to control one or more combustion air system dampers based on oxygen content sensor signals, to control combustion air delivered to the primary combustion chamber.

10. The system of claim 1, wherein the programmable logic controller is configured to control the amount of SNCR reagent delivered to the secondary combustion chamber based on NOx content sensor signals.

11. An incinerator system that provides flue gas recirculation and selective noncatalytic reduction (SNCR) for reducing NOx and CO emissions, the incinerator system comprising:

a primary combustion chamber configured to:

receive waste materials from a loader;

receive an amount of above-fire combustion air and an amount of under-fire combustion air; and produce partially combusted waste materials and post-combustion flue gas;

a secondary combustion chamber configured to:

receive the partially combusted waste materials and post-combustion flue gas from the primary combustion chamber;

produce substantially combusted waste materials and an amount of oxidized flue gas;

wherein the delivered SNCR reagent initiates an SNCR process that reduces NOx in the oxidized flue gas;

a flue gas recirculation system downstream of the secondary combustion chamber and configured to:

receive the substantially combusted waste materials and oxidized flue gas from the secondary combustion chamber; and produce and deliver (a) above-fire flue gas recirculation gas and (b) under-fire gas recirculation gas to the primary combustion chamber to reduce a temperature in the primary combustion chamber to provide a first NOX reduction in the flue gas;

an SNCR system configured to deliver a controlled amount of SNCR reagent to the secondary combustion chamber to provide a second NOX reduction in the flue gas;

a sensor system configured to measure a plurality of incinerator parameters, including at least one temperature sensor associated with the primary combustion chamber; and a programmable logic controller configured to:

control the above-fire and under-fire gas recirculation gasses delivered to the primary combustion chamber, including:

receiving temperature sensor signals from the at least one temperature sensor indicating a measured temperature in the primary combustion chamber;

comparing the measured temperature in the primary combustion chamber with at least one set point temperature; and based at least on the comparison of the measured temperature in the primary combustion chamber with the at least one set point temperature:

dynamically controlling one or more dampers of the flue gas recirculation system to control the above-fire and under-fire gas recirculation gasses delivered to the primary combustion chamber:

control the amount of above-fire combustion air and the amount of under-fire combustion air delivered to the primary combustion chamber based on sensor signals received from the sensor system; and control at least one injection nozzle to adjust an angle of injection of the SNCR reagent into the secondary combustion chamber.

12. The system of claim 11, wherein the sensor system further includes at least one of the following: at least one oxygen sensor, at least one NOx sensor, or at least one CO sensor.

13. The system of claim 11, wherein the amount of above-fire combustion air and the amount of under-fire combustion air are controlled by one or more combustion air dampers.

14. The system of claim 13, wherein the amount of above-fire combustion air and the amount of under-fire combustion air received at the primary combustion chamber each have an oxygen content of about 21%.

15. The system of claim 11, wherein the reagent comprises urea.

16. The system of claim 11, wherein the flue gas recirculation system comprises a heat recovery system and a cyclone.

17. The system of claim 11, wherein:

the flue gas recirculation system is further configured to produce and deliver secondary recirculation gas to the secondary combustion chamber; and the programmable logic controller is further configured to:

dynamically control, based on the sensor signals received from the sensor system, the secondary recirculation gas delivered to the secondary combustion chamber.

18. The system of claim 11, wherein the programmable logic controller is configured to control one or more combustion air system dampers based on oxygen content sensor signals, to control combustion air delivered to the primary combustion chamber.

19. The system of claim 11, wherein the programmable logic controller is configured to control the amount of SNCR reagent delivered to the secondary combustion chamber based on NOx content sensor signals.

* * * * *